US008312880B2

(12) United States Patent
Hk

(10) Patent No.: US 8,312,880 B2
(45) Date of Patent: Nov. 20, 2012

(54) ADAPTABLE DEMAND DILUTION OXYGEN REGULATOR FOR USE IN AIRCRAFTS

(75) Inventor: Anurag Sharma Hk, Bangalore (IN)

(73) Assignee: Airbus Engineering Centre India, Bangalore, Karnataka (IN)

( * ) Notice: Subject to any disclaimer, the term of this patent is extended or adjusted under 35 U.S.C. 154(b) by 348 days.

(21) Appl. No.: 12/748,473

(22) Filed: Mar. 29, 2010

(65) Prior Publication Data

US 2010/0258127 A1 Oct. 14, 2010

(30) Foreign Application Priority Data

Apr. 8, 2009 (IN) ..... 808/CHE/2009

(51) Int. Cl.
*A62B 9/02* (2006.01)
*A62B 7/14* (2006.01)

(52) U.S. Cl. ..... 128/205.11; 128/205.24; 128/205.23

(58) Field of Classification Search ..... 128/200.24, 128/200.12, 200.14, 200.18, 200.23, 200.29, 128/205.11, 205.23, 205.24; 244/118.5
See application file for complete search history.

(56) References Cited

U.S. PATENT DOCUMENTS 5,460,175 A * 10/1995 Foote et al. ..... 128/205.24
8,052,087 B2 * 11/2011 Jorn ..... 244/118.5

OTHER PUBLICATIONS

California Thoracic Society "Safe Flying for PEople with Lung Disease", May 2, 2007.*

* cited by examiner

*Primary Examiner* — Jackie Ho
*Assistant Examiner* — Mark Wardas
(74) *Attorney, Agent, or Firm* — Prakash Nama; Global IP Services, PLLC

(57) ABSTRACT

A system and method of automatic delivery of appropriate flow rate of oxygen to a person flying in a pressurized aircraft cabin is disclosed. In one embodiment, an adaptable demand dilution oxygen regulator for use inside a pressurized aircraft cabin, includes an oxygen initiation and demand regulation system adapted to be responsive to differential gas pressure in a first altitude range based on a pulmonary capacity of a person flying in the pressurized aircraft cabin and to control flow of pressurized oxygen to a breathing outlet during the first altitude range. The adaptable demand dilution oxygen regulator further includes a cabin air dilution and delivery system, coupled to the oxygen initiation and demand regulation system, adapted to be responsive to differential gas pressure in a second altitude range and to output progressively enriched mixture till 100% pressurized oxygen into a breathing apparatus during the second altitude range.

13 Claims, 9 Drawing Sheets

ADAPTABLE DEMAND DILUTION OXYGEN REGULATOR FOR USE IN AIRCRAFTS

RELATED APPLICATIONS

Benefit is claimed under 35 U.S.C. 119(a)-(d) to Foreign application Serial No. 808/CHE/2009 entitled "ADAPTABLE DEMAND DILUTION OXYGEN REGULATOR FOR USE IN AIRCRAFTS" by Airbus Engineering Centre India, filed on Apr. 8, 2009, which is herein incorporated in its entirety by reference for all purposes.

FIELD OF TECHNOLOGY

The present invention relates generally to aero-medical devices, and more particularly relates to adaptable/configurable demand dilution oxygen regulator for use inside aircraft cabin.

BACKGROUND

Typically in an aircraft, aircraft cabin air pressure in terms of pressure altitude is in the range of 3000 to 8000 feet, which is generally less than a pressure encountered at a ground level. Persons with impaired pulmonary capacity are not fit to travel in the reduced aircraft cabin air pressure associated with low oxygen levels (e.g., due to recirculation of aircraft cabin air by air conditioning/environmental control system (ECS) in the aircraft). This is especially true for persons suffering or predisposed to conditions including but not limited to chronic bronchitis, emphysema, bronchiectasis, dyspnoea at rest, corpulmonale, severe asthma, anemia (sickle cell hemoglobin and betathalassaemia) and the like. This can also include persons who have undergone recent lung, chest injury/surgery/pulmonary infections. That is, the persons to whom exposure to higher altitudes/low oxygen levels normally encountered in an aircraft cabin may cause under oxygenation of blood hemoglobin and subsequent tissue hypoxia.

Currently, such individuals are transported using a flight that provides special oxygen supply and cabin altitude not exceeding a guaranteed 3500/4000 feet ambient. This may require flying at an extraordinarily uneconomical altitude for the aircraft or evacuating using dedicated military aircraft (such as turboprop or chartered flights) with large volume oxygen supply on board. In either case, it is a high cost that is generally not covered by social health schemes and health insurances. For short distances, helicopters are used typically for such purposes.

However, none of these current solutions are economically viable as they all require flying at nearly surface level, monitoring and adjusting oxygen by medical attendants, remaining on a large volume oxygen supply, and so on. Further, today's demand dilution oxygen regulators for aviation use operate above a pressure altitude of 10000 to 12000 feet.

SUMMARY

An adaptable demand dilution oxygen regulator for use in aircrafts is disclosed. According to an aspect of the present invention, an adaptable demand dilution oxygen regulator for use inside a pressurized aircraft cabin includes an oxygen initiation and demand regulation system adapted to be responsive to differential gas pressure in a first altitude range based on a pulmonary capacity of a person flying in the pressurized aircraft cabin, where the oxygen initiation and demand regulation system controls flow of pressurized oxygen to a breathing outlet by mixing the pressurized oxygen with aircraft cabin air during the first altitude range.

The adaptable demand dilution oxygen regulator further includes a cabin air dilution and delivery system, coupled to the oxygen initiation and demand regulation system, adapted to be responsive to differential gas pressure in a second altitude range, where the cabin air dilution and delivery system gradually stops dilution of the aircraft cabin air and outputs approximately about 100% pressurized oxygen into a breathing apparatus via the breathing outlet during the second altitude range. For example, the first altitude range and the second altitude range are substantially below a cabin pressure altitude of approximately about 7000 feet and the first altitude range is lower than the second altitude range.

According to another aspect of the present invention, a method for automatic delivery of appropriate flow rate of oxygen from a portable personal oxygen bottle through a breathing apparatus to a person flying in a pressurized aircraft cabin includes presetting a first aneroid valve that is responsive to differential gas pressure in a first altitude range to close at a oxygen starting altitude point based on apriori lung capacity test, and initiating a flow of oxygen from the portable personal oxygen bottle using a quarter turn switching regulator connected to the portable personal oxygen bottle via a minimum flow area of the main valve to output the mixture of the flow of oxygen and aircraft cabin air into a mixing chamber.

The method further includes gradually closing the first aneroid valve in response to increase in aircraft cabin pressure altitude to stop a pilot flow of oxygen during the first altitude range, and opening a main valve upon closing the first aneroid valve to flow pressurized oxygen into the mixing chamber, where the aircraft cabin air is also outputted into the mixing chamber such that the pressurized oxygen and the outputted aircraft cabin air are having substantially same pressure, and where the mixture of aircraft cabin air and pressurized oxygen in the mixing chamber is outputted into the breathing apparatus via a breathing outlet.

Furthermore, the method includes presetting a second aneroid valve, that is responsive to differential gas pressure in a second altitude range to close at a predefined aircraft cabin airflow stopping altitude point, substantially simultaneously upon presetting the first aneroid valve to the oxygen starting altitude point and gradually closing the second aneroid valve in response to increasing aircraft cabin pressure altitude to stop the aircraft cabin air flowing into the mixing chamber during the second altitude range.

Moreover, the method includes outputting approximately about 100% pressurized oxygen into the breathing apparatus via the breathing outlet upon substantially closing the second aneroid valve and upon reaching the predefined aircraft cabin airflow stopping altitude point. The predefined aircraft cabin airflow stopping altitude point is substantially above the oxygen starting altitude point and the second altitude range is higher than the first altitude range.

The methods and systems disclosed herein may be implemented in any means for achieving various aspects. Other features will be apparent from the accompanying drawings and from the detailed description that follows.

BRIEF DESCRIPTION OF THE DRAWINGS

Embodiments of the present invention are illustrated by way of an example and not limited to the figures of the accompanying drawings, in which like references indicate similar elements and in which.

Other features of the present embodiments will be apparent from the accompanying drawings and from the detailed description that follows.

DETAILED DESCRIPTION

An adaptable demand dilution oxygen regulator for use in aircrafts is disclosed. In the following detailed description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined only by the appended claims.

Figure 1:
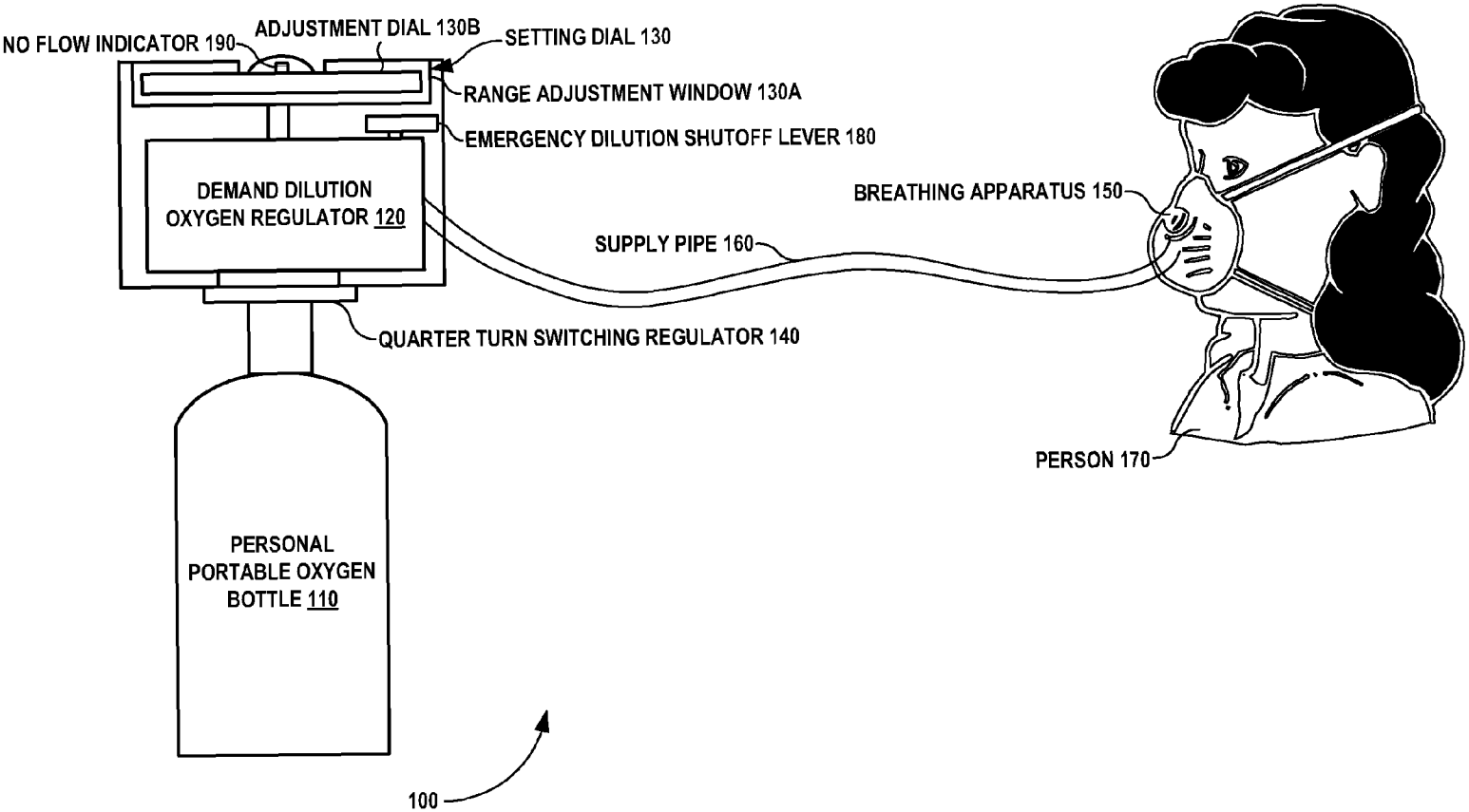
FIG. 1 illustrates an exemplary adaptable demand dilution oxygen system for use inside a pressurized aircraft cabin, according to one embodiment.

FIG. 1 illustrates an exemplary adaptable demand dilution oxygen system 100 for use inside a pressurized aircraft cabin, according to one embodiment. As shown in FIG. 1, the demand dilution oxygen system 100 includes a portable personal oxygen bottle 110 and a configurable demand dilution oxygen regulator 120 with a setting dial 130. The demand dilution oxygen regulator 120 with the setting dial 130 is screwed on top of the portable personal oxygen bottle 110 using a quarter turn switching regulator 140 to receive pressurized oxygen. For example, the portable personal oxygen bottle 110 has a capacity of approximately in the range of about 2 to 7 liters.

The quarter turn switching regulator 140 enables initiation of flow of pressurized oxygen when the demand dilution oxygen regulator 120 is screwed by a quarter turn and stopping of the flow of pressurized oxygen when the demand dilution oxygen regulator 120 is unscrewed by a quarter turn. This prevents wastage of the oxygen from the portable personal oxygen bottle 110.

Further, the demand dilution oxygen regulator 120 is coupled to a breathing apparatus 150 (e.g., a breathing mask incorporating an anti-suffocation inlet valve) via a supply pipe 160 for automatically delivering appropriate flow rate of pressurized oxygen from the portable personal oxygen bottle 110 to the breathing apparatus 150 of a person 170 (with reduced/impaired pulmonary capacity) flying in the pressurized aircraft cabin. It is appreciated that, the demand dilution oxygen regulator 120 is adapted to be responsive to differential gas pressure in a selected pressure altitude in a first altitude range and in a corresponding pressure altitude in a second altitude range, respectively. It should be noted that, the first altitude range and the second altitude range are substantially below a maximum cabin pressure altitude of approximately about 7000 feet and the first altitude range is lower than the second altitude range. Further, the first altitude range is in the range of about 2000 to 4000 feet in pressure altitude and the second altitude range is in the range of about 4000 to 6000 feet in pressure altitude.

The setting dial 130 attached to the demand dilution oxygen regulator 120 enables presetting of an oxygen starting altitude point in the first altitude range and a corresponding predefined aircraft cabin airflow stopping altitude point in the second altitude range. It should be noted that, the predefined aircraft cabin airflow stopping altitude point is substantially above the oxygen starting altitude point (e.g., 2000 feet). The setting dial 130 includes a range adjustment window (shown in FIG. 2) and an adjustment dial 130A, where the adjustment dial 130A consists of markings (feet in pressure altitude) and the range adjustment window is used to preset the oxygen starting altitude point by rotating the adjustment dial 130A.

In one embodiment, a physician of the person 170 flying in the pressurized aircraft cabin presets the oxygen starting altitude point based on a prior lung capacity test of the person 170 (e.g., using the setting dial 130 on the ground before embarkation). In this embodiment, the setting dial 130 automatically presets the corresponding predefined aircraft cabin airflow stopping altitude point based on the preset oxygen starting altitude point. Thus, based on the settings made using the setting dial 130, the demand dilution oxygen regulator 120 starts the flow of pressurized oxygen upon reaching the oxygen starting altitude point.

Further, the demand dilution oxygen regulator 120 gradually increases the oxygen content (by gradually stopping aircraft cabin dilution airflow) with the increasing aircraft cabin pressure altitude to output approximately about 100% pressurized oxygen into the breathing apparatus 150 upon reaching the predefined aircraft cabin airflow stopping altitude point. The setting dial 130 may also include a top cover to protect the adjustment dial 130A from being tampered after the oxygen starting altitude point and the corresponding predefined aircraft cabin airflow stopping altitude point are set by the physician of the person 170.

As shown in FIG. 1, the demand dilution oxygen regulator 120 also includes an emergency dilution shutoff lever 180 to output approximately about 100% pressurized oxygen into the breathing apparatus 150 if the person 170 desires to at any time (e.g., based on the condition of the person 170 irrespective of aircraft cabin pressure altitude). Also, as shown in FIG. 1, the demand dilution oxygen regulator 120 includes a no flow indicator 190 for indicating a no flow condition of the oxygen to the breathing apparatus 150 when the demand dilution oxygen regulator 120 fails or when the portable personal oxygen bottle 110 becomes empty.

Figure 3:
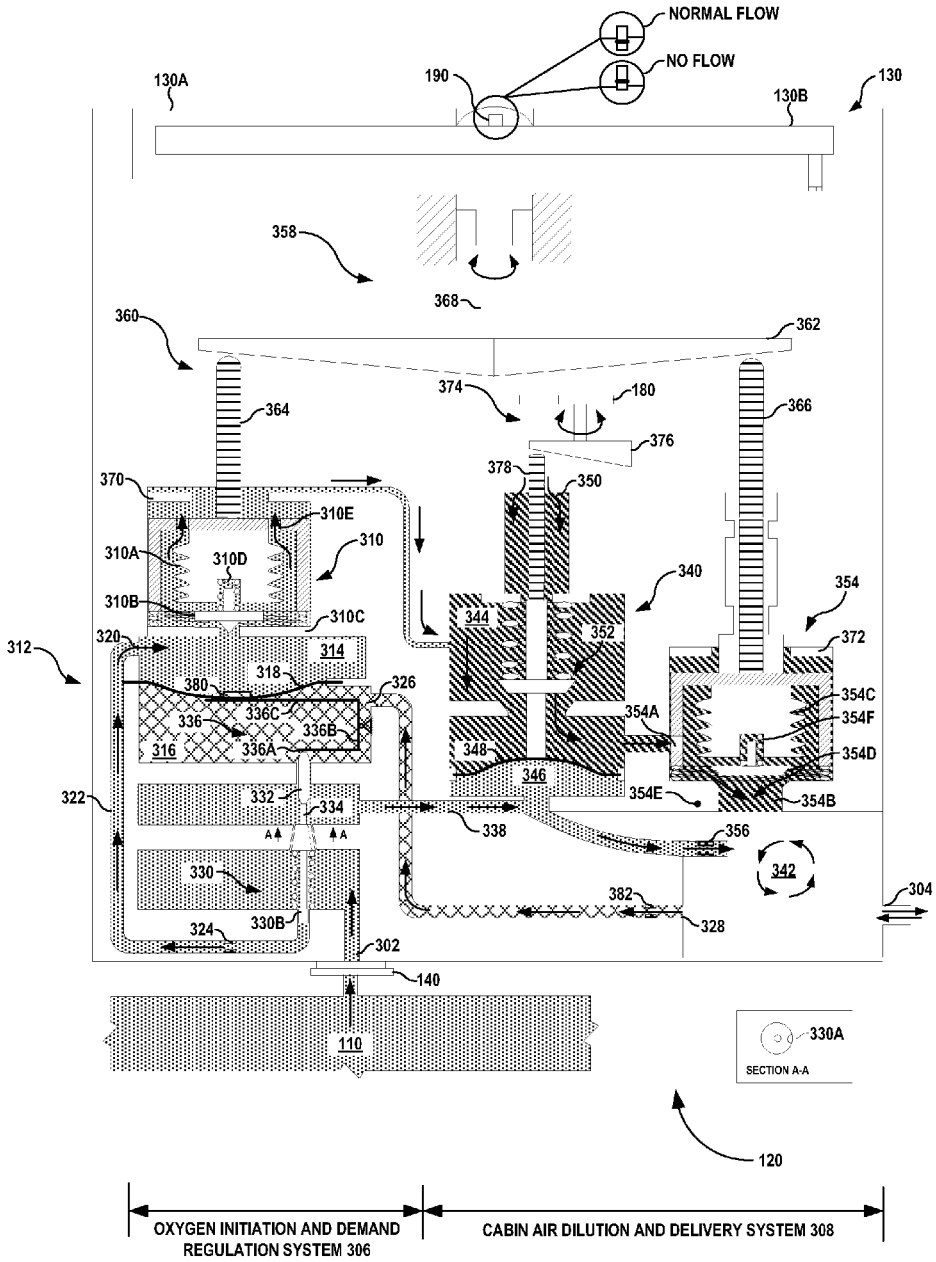
FIG. 3 is a schematic representation of an exemplary adaptable demand dilution oxygen regulator with two aneroid valves, according to one embodiment.

In one exemplary implementation, the no flow indicator 190 includes a red band indicator marked on a shaft which pops out in a hermetic plexiglass window to indicate the no flow condition, which is described in greater detail in the description of FIG. 3. Thus, the no flow indicator 190 can be seen through the hermetic plexiglass window placed on top of the setting dial 130. Moreover, the demand dilution oxygen regulator 120 is explained in greater detail with respect to FIGS. 3 through 5.

Figure 2:
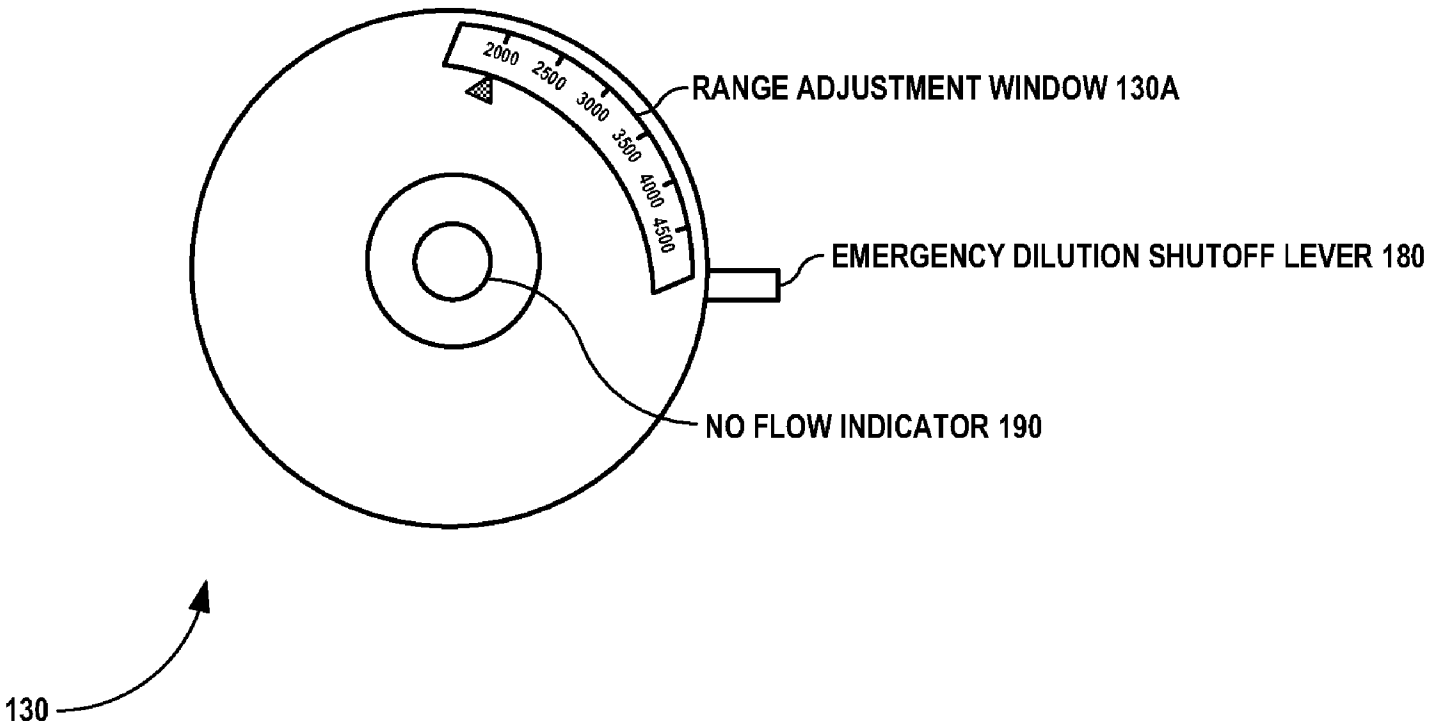
FIG. 2 illustrates an exemplary range adjustment window of the setting dial, such as those shown in FIG. 1, according to one embodiment.

FIG. 2 illustrates an exemplary range adjustment window 210 of the setting dial 130, such as those shown in FIG. 1, according to one embodiment. The range adjustment window 210 of the setting dial 130 enables the physician of the person 170 to preset an oxygen starting altitude point using the adjustment dial 130A (as shown in FIG. 1) and thereby automatically preset a corresponding predefined aircraft cabin airflow stopping altitude point. Further, the physician of the person 170 is allowed to lock the adjustment dial 130A using a locking mechanism (e.g., a set screw) provided at the bottom of the setting dial 130. This facilitates to retain the setting set by the physician of the person 170.

As shown in FIG. 2, the range adjustment window 210 of the setting dial 130 provides a visual means to visualize markings on the adjustment dial 130A of the setting dial 130 while presetting the oxygen starting altitude point. In one embodiment, the range adjustment window 210 enables the physician of the person 170 to see the preset oxygen starting altitude point and the corresponding predefined aircraft cabin airflow stopping altitude point.

FIG. 3 is a schematic representation of an exemplary adaptable demand dilution oxygen regulator 120 with two aneroid valves, according to one embodiment. As illustrated in FIG. 3, the demand dilution oxygen regulator 120 consists of an inlet port 302 normally connected to a supply of pressurized oxygen from the portable personal oxygen bottle 110 and a breathing outlet 304 adapted to be connected to the breathing apparatus 150 of the person 170 flying in a pressurized aircraft cabin for delivering appropriate flow rate of diluted or undiluted pressurized oxygen.

The demand dilution oxygen regulator 120 consists of an oxygen initiation and demand regulation system 306 adapted to be responsive to differential gas pressure between a first altitude range and an aircraft cabin air pressure based on apriori lung capacity test of the person 170 to control the flow of pressurized oxygen mixed in aircraft cabin air during the first altitude range. The demand dilution oxygen regulator 120 further includes a cabin air dilution and delivery system 308, coupled to the oxygen initiation and demand regulation system 306, adapted to be responsive to differential gas pressure between a second altitude range and the aircraft cabin air pressure.

The oxygen initiation and demand regulation system 306 consists of a first aneroid valve 310, and a balanced oxygen delivery valve 312. The first aneroid valve 310 consists of an aneroid capsule 310A, a valve member 310B, a valve seat 310C and a light spring 310D which allows the aneroid capsule 310A to continue to expand (e.g., in response to the increasing aircraft cabin pressure altitude) after the first aneroid valve 310 is closed without overstressing the assembly. It should be noted that, the first aneroid valve 310 is adapted to be responsive to differential gas pressure (e.g., the pressure difference outside and inside of the aneroid capsule 310A, i.e., difference in the aircraft cabin air pressure and the sealed pressure) between the first altitude range and the aircraft cabin air pressure based on an appropriate setting for pulmonary capacity of the person 170 flying in the pressurized aircraft cabin.

The balanced oxygen delivery valve 312 consists of a first chamber 314, a second chamber 316 and a diaphragm 318. The diaphragm 318 separates the first chamber 314 and the second chamber 316 and is displaced in a direction normal to the diaphragm 318 in response to differential gas pressure between the first chamber 314 and the second chamber 316.

The first chamber 314 is responsive to a bleed pilot pressure of the oxygen from the portable personal oxygen bottle 110 received via a first port 320, adapted to receive a pilot flow of oxygen via a bleed line 322 (communicated using a restrictor orifice 324). The second chamber 316 is responsive to demand pressure, communicated using a restrictor orifice 382, received via a second port 326 from a demand pressure inlet 328 connected to the second chamber 316. The demand pressure inlet 328 is adapted to receive the demand pressure from the breathing outlet 304 connected to the breathing apparatus 150.

Further, the balanced oxygen valve 312 consists of a main valve 330, a rod end 332 and a valve stem 334 (i.e., a forwardly extending stem) connecting the main valve 330 and the rod end 332. The main valve 330 consists of a valve member, a valve seat and a light spring. The main valve 330 is normally held in closed position by the light spring and is operated to regulate the flow of pressurized oxygen delivered to the person 170 flying in the pressurized aircraft cabin, through the rod end 332 and the valve stem 334, in response to the deflection of the diaphragm 318.

As illustrated, the rod end 332 bears against a short leg 336A of a lever 336 (e.g., a bell crank lever) pivoted on a pin 336B. A long leg 336C of the lever 336 bears generally upon a central portion of the diaphragm 318 and is rotated about the pin 336B in response to the deflection of the diaphragm 318. This in turn controls the position of the main valve 330 and hence the flow of pressurized oxygen supplied to the person 170 flying in the pressurized aircraft cabin via an oxygen line 338.

It should be noted that the spring lightly biases the main valve 330 toward the closed position so that the main valve 330 is closed when the bleed pilot pressure of oxygen in the first chamber 314 is low (i.e., till the first aneroid valve 310 is open). However, the main valve 330 opens when the diaphragm 318 deflects upon closing the first aneroid valve 310 and when the bleed pilot pressure of oxygen further actuates the diaphragm 318 against the demand pressure in the second chamber 316 to operate the main valve 330 via the lever 336. In one exemplary implementation, the demand pressure inlet 328 is adapted to regulate the main valve 330 to control the flow of pressurized oxygen to the breathing outlet 304 based on the demand pressure received by the second port 326 from the breathing apparatus 150 via the demand pressure inlet 328.

The main valve 330 also consists of a minimum flow area 330A (i.e., a cut-out in the valve member) and a rearwardly extending stem including a member 330B for providing the minimum flow of oxygen from the portable personal oxygen bottle 110 during the first altitude range. The pilot flow of oxygen, due to leakage via the member 330B, is communicated to the first port 320 into the first chamber 314 via the bleed line 322. In accordance with the above described embodiments, the first aneroid valve 310 consists of an outlet 310E to vent the pilot flow of oxygen received via the first port 320 to a cabin air dilution path in the first altitude range. Also, the minimum flow of oxygen, due to leakage via the minimum flow area 330A, is communicated to the breathing outlet 304 via the oxygen line 338.

The cabin air dilution and delivery system 308 consists of a cabin air chamber 340 and a mixing chamber 342. The cabin air chamber 340 consists of a first chamber 344, a second chamber 346 and a diaphragm 348. As illustrated, the diaphragm 348 separates the first chamber 344 and the second chamber 346. The cabin air chamber 340 is open to aircraft cabin air received via an aircraft cabin air inlet 350. In one embodiment, the first chamber 344 is adapted to receive the pilot flow of oxygen from the outlet 310E associated with the first aneroid valve 310 and the aircraft cabin air from the aircraft cabin air inlet 350. In this embodiment, the first chamber 344 is adapted to mix the pilot flow of oxygen and the aircraft cabin air to form a mixture of partially enriched aircraft cabin air in the first altitude range. In another embodiment, the first chamber 344 is adapted to receive only aircraft cabin air via the aircraft cabin air inlet 350 in the second altitude range. The second chamber 346 is adapted to receive the flow of pressurized oxygen from the portable personal oxygen bottle 110 via the main valve 330.

The diaphragm 348 ensures that the pressure of the aircraft cabin air and the pressure of the flow of pressurized oxygen going into the mixing chamber 342 are substantially equal, thereby controlling the mixing ratio by respective flow areas. The cabin air chamber 340 also includes a cabin air valve 352 which is regulated by the diaphragm 348 such that the pressure of the aircraft cabin air and the flow of pressurized oxygen going into the mixing chamber 342 are substantially equal. The cabin air valve 352 consists of a valve member 352A, a valve seat 352B, and a spring 352C which lightly biases the valve member 352A toward the valve seat 352B in response to the position of the diaphragm 348 (which is adapted to be responsive to the difference in pressure of the flow of pressurized oxygen in the second chamber 346 and the pressure of the aircraft cabin air in the first chamber 344).

The cabin air dilution and delivery system 308 also includes a second aneroid valve 354 consisting of an inlet port 354A and an outlet port 354B. The inlet port 354A is adapted to receive the aircraft cabin air from the first chamber 344 of the cabin air chamber 340. In one embodiment, the second aneroid valve 354 is adapted to be responsive to differential gas pressure (e.g., pressure difference outside and inside of the second aneroid valve 354, i.e., difference in the aircraft cabin air pressure and the sealed pressure) between the second altitude range and the aircraft cabin air pressure for regulating flow of the aircraft cabin air going into the mixing chamber 342 via the outlet port 354B.

The second aneroid valve 354 further consists of an aneroid capsule 354C, a valve member 354D (e.g., made of rubber), a valve seat 354E and a light spring 354F which allows the aneroid capsule 354C to expand after the second aneroid valve 354 is closed to prevent overstressing of the assembly due to the expansion of the aneroid capsule 354C during the second altitude range.

In one embodiment, the mixing chamber 342 is adapted to receive and mix the flow of pressurized oxygen via the main valve 330 and the aircraft cabin air via the outlet port 354B and output the mixture to the breathing apparatus 150 of the person 170 flying in the pressurized aircraft cabin via the breathing outlet 304. It can be seen in FIG. 3 that, the flow of pressurized oxygen is communicated to the mixing chamber 342 via the oxygen line 338 through means such as jet 356.

In some embodiments, the second aneroid valve 354 is gradually closed in response to increasing aircraft cabin pressure altitude to stop the aircraft cabin air flowing into the mixing chamber 342 during the second altitude range. In these embodiments, the mixing chamber 342 outputs approximately about 100% pressurized oxygen into the breathing apparatus 150 upon substantially closing the second aneroid valve 354.

It is appreciated that, the first aneroid valve 310 is designed to initiate the flow of pressurized oxygen to the breathing outlet 304 during the first altitude range and the second aneroid valve 354 is designed to increasingly throttle the flow area of aircraft cabin air during the second altitude range in such a way that the mixture provided at the breathing outlet 304 increases in oxygen content until at a predefined aircraft cabin pressure altitude, the second aneroid valve 354 closes completely and delivers approximately about 100% pressurized oxygen.

It can be noted that, the first aneroid valve 310 and the second aneroid valve 354 are matched pairs (i.e., having similar characteristics) but operate during the first altitude range and the second altitude range, respectively due to the varying design dimensions in valve members and valve seats of the first aneroid valve 310 and the second aneroid valve 354. It can also be noted that, the light spring 310D associated with the first aneroid valve 310 and the light spring 354F associated with the second aneroid valve 354 facilitates expansion of the aneroid capsule 310A and the aneroid capsule 354C, respectively even after the first aneroid valve 310 and the second aneroid valve 354 are closed. This helps prevent the aneroid capsule 310A and the aneroid capsule 354C from losing its characteristics.

The demand dilution oxygen regulator 120 further consists of a dial mechanism 358 for presetting an oxygen starting altitude point in the first altitude range for providing the flow of pressurized oxygen via the main valve 330 and for providing a visual means (e.g., the range adjustment window 210) to see the preset oxygen starting altitude point. In other words, the dial mechanism 358 facilitates the physician of the person 170 to preset the first aneroid valve 310 and the second aneroid valve 354, substantially simultaneously via the setting dial 130 (as illustrated in FIGS. 1 and 2), to close at the oxygen starting altitude point and a corresponding predefined cabin airflow stopping altitude point, respectively.

As illustrated in FIG. 3, the dial mechanism 358 includes a cam plate and follower mechanism 360 operable for presetting the oxygen starting altitude point to respond to the differential gas pressure in the first altitude range based on the pulmonary capacity of the person 170 flying in the pressurized aircraft cabin. Further, the cam plate and follower mechanism 360 is operable for simultaneously presetting the corresponding predefined aircraft airflow stopping altitude point to respond to the differential gas pressure in the second altitude range and to stop the dilution of the aircraft cabin air into the mixing chamber 342.

Figure 4A:
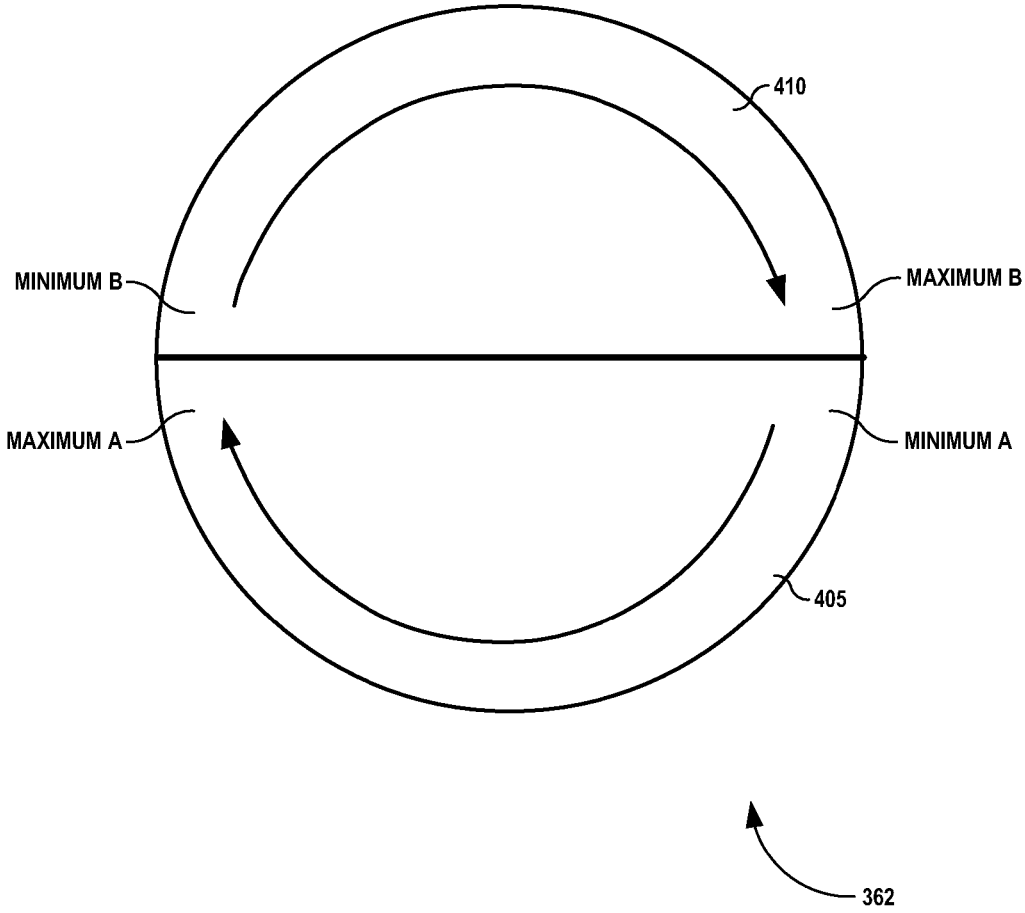
FIG. 4A illustrates a perspective view of a cam plate of a cam plate and follower mechanism of FIG. 3, according to one embodiment.

Further, as shown in FIG. 3, the cam plate and follower mechanism 360 includes a cam plate 362 and followers 364 and 366. The cam plate 362 includes two cams (as illustrated in FIG. 4A) for displacing the followers 364 and 366. The cam plate 362 is coupled to the setting dial 130 via a shaft 368. In one exemplary implementation, the cam plate 362 is adapted to be responsive to the rotation of the adjustment dial 130A for presetting the oxygen starting altitude point and the corresponding predefined oxygen aircraft cabin airflow stopping altitude point.

As mentioned above, the oxygen starting altitude point and the predefined aircraft cabin airflow stopping altitude point are preset by the physician of the person 170 through the rotation of the adjustment dial 130A. This causes the cam plate 362 to turn by an angle which in turn displaces the followers 364 and 366, coupled to the first aneroid valve 310 and the second aneroid valve 354, respectively, substantially simultaneously by the same distance. Thus, the displacement of the followers 364 and 366 presets the first aneroid valve 310 and the second aneroid 354, respectively. Further, the operation of the cam plate and follower mechanism 360 is described in greater details in FIGS. 4A through 4C.

The demand dilution oxygen regulator 120 also includes stops 370 and 372 placed above the first aneroid valve 310 and the second aneroid valve 354 to avoid incorrect presetting of the oxygen starting altitude point (e.g., above 4000 feet). For example, in case of incorrect presetting is performed, the demand dilution oxygen regulator 120 delivers approximately about 100% pressurized oxygen once the aircraft cabin pressure altitude reaches a predefined aircraft cabin airflow stopping altitude point (e.g., 6000 feet). Also, in case if the aircraft cabin pressure altitude drops below the second aneroid valve setting (referred to as aircraft cabin decompression point), the first aneroid valve 310 and the second aneroid valve 354 automatically closes to stop the flow of aircraft cabin air into the mixing chamber 342 and to instantaneously supply approximately about 100% pressurized oxygen into the breathing apparatus 150 via the breathing outlet 304.

The demand dilution oxygen regulator 120 consists of the emergency dilution shutoff lever 180 including a cam and follower mechanism 374. The emergency dilution shutoff lever 180 enables shutting off the aircraft cabin air flowing into the mixing chamber 342 and delivering approximately about 100% pressurized oxygen via the breathing outlet 304 during emergency. The cam and follower mechanism 374 consists of a cam 376 and a follower 378 which is actuated by the manual operation.

The emergency dilution shutoff lever 180 is coupled to the cabin air valve 352 of the cabin air dilution and delivery system 308 such that operation of the emergency dilution shutoff lever 180 causes the cam 376 to move sharp downwards and hence the follower 378 to bias the cabin air valve 352 coupled to the follower 378 toward a closed condition. Further, closing of the cabin air valve 352 by operation of the emergency dilution shutoff lever 180 shuts off the flow of aircraft cabin air into the mixing chamber 342 to deliver approximately about 100% pressurized oxygen to the breathing apparatus 150. In one embodiment, the cabin air valve 352 is responsive to the differential gas pressure between the flow of pressurized oxygen to the breathing outlet 304 and the aircraft cabin air in the cabin air chamber 340 to regulate the mixture of the flow of pressurized oxygen and the aircraft cabin air received in the mixing chamber 342.

As mentioned above, the demand dilution oxygen regulator 120 consists of the no flow indicator 190 (as shown in FIGS. 1 and 2) to indicate a no flow condition when the personal portable oxygen bottle 110 becomes empty or when the demand dilution oxygen regulator 120 fails. As shown in FIG. 3, a magnet 380 is mounted on the diaphragm 318 and a shaft with magnetic end (not shown) which extends till the setting dial 130 is placed above the magnet 380 with an air gap between them.

When the portable personal oxygen bottle 110 becomes empty and/or fails to supply the pilot flow of oxygen via the bleed line 322, the bleed pilot pressure of oxygen in the first chamber 314 drops below the demand pressure in the second chamber 316. As a result, the diaphragm 318 comes to a neutral position and hence the magnet 380 mounted on the diaphragm 318 moves closer to the shaft. Further, due to repulsion between the shaft magnet and the magnet 380, the shaft experiences an upward movement (e.g., similar to a reed relay switch operation). The upward movement of the shaft causes the red band indicator (marked on other end of the shaft) to pop out which in turn is visible through the hermetic plexiglass window, indicating a no flow condition (e.g., empty condition of the portable personal oxygen bottle 110).

For the purpose of illustration, consider that, at ground level (i.e., at 0 feet), a physician of the person 170 flying in the pressurized aircraft cabin presets the demand dilution oxygen regulator 120 to start flow of pressurized oxygen at an oxygen starting altitude point, say 2000 feet in pressure altitude and provide approximately about 100% oxygen at a predefined aircraft cabin airflow stopping altitude point, say 4000 feet, using the dial mechanism 358. Presetting using the setting dial 130 causes the first aneroid valve 310 to operate between a first altitude range of 0 to 2000 feet and completely cutoff the pilot flow of oxygen at 2000 feet and the second aneroid valve 354 to operate between a second altitude range of 2000 to 4000 feet and completely cutoff the aircraft cabin dilution airflow at 4000 feet.

In operation, the oxygen supply from the portable personal oxygen bottle 110 to the demand dilution oxygen regulator 120 is initiated by switching on the quarter turn switching regulator 140 (by screwing it further by a quarter turn after the regulator is fully screwed into the portable personal oxygen bottle 110). It is appreciated that the initiation of the supply of pressurized oxygen to the demand dilution oxygen regulator 120 is performed at the ground level (i.e., 0 feet in pressure altitude) or any aircraft cabin pressure altitude above ground level based on a pulmonary capacity of the person 170 flying in the pressurized aircraft cabin.

When the quarter turn switching regulator 140 is switched on, both the first aneroid valve 310 and the second aneroid valve 354 are open. Further, the main valve 330 is in the closed position and the breathing outlet 304 of the demand dilution oxygen regulator 120 is connected to the breathing apparatus 150 of the person 170 flying in the pressurized aircraft cabin.

Upon initiation, as the main valve 330 is in the closed position, a minimum flow of pressurized oxygen is initiated via the minimum flow area 330A of the main valve 330 to the mixing chamber 342. Also, a pilot bleed leaks via the bleed line 322 to the first chamber 314 through the first port 320. Further, the pilot flow of oxygen received in the first chamber 314 via the first port 320 is vented through the outlet 310E associated with the first aneroid valve 310 to a cabin air dilution path and mixed with aircraft cabin air received via the aircraft cabin air inlet 350.

Then, the partially enriched aircraft cabin air is outputted into the mixing chamber 342 through the output port 354B associated with the second aneroid valve 354. Furthermore, the partially enriched aircraft cabin air and the minimum flow of pressurized oxygen received via the minimum flow area 330A of the main valve 330 are mixed in the mixing chamber 342 and outputted into the breathing apparatus 150 via the breathing outlet 304. The above-mentioned process occurs during the normal mode of operation, i.e., when the aircraft cabin pressure altitude is 0 feet.

Since, the first aneroid valve 310 and the second aneroid valve 354 are adapted to be responsive to the differential gas pressure in 0 to 2000 feet and 2000 to 4000 feet in pressure altitude, respectively, working of the demand dilution oxygen regulator 120 when the aircraft cabin pressure altitude is in the range of 0 to 4000 feet to gradually supply approximately about 100% pressurized oxygen to the breathing apparatus 150 is discussed below.

As the aircraft cabin pressure altitude starts increasing (i.e., 0 feet and above), the aneroid capsule 310A associated with the first aneroid valve 310 and the aneroid capsule 354C associated with the second aneroid valve 354 undergoes expansion. Due to which, the valve member 310B associated with the first aneroid valve 310 and the valve member 354D associated with the second aneroid valve 354 move toward the valve seat 310C and the valve seat 354E respectively, thereby reducing the area of valve opening. Further, the first aneroid valve 310 gradually closes at 2000 feet (i.e., at the oxygen starting altitude point), and the pilot flow of oxygen vented into the cabin air dilution path is stopped.

As a consequence, the outlet port 354B of the second aneroid valve 354 substantially outputs only the aircraft cabin air into the mixing chamber 342 from 2000 feet and above. Further, closing of the first aneroid valve 310 at 2000 feet results in gradual increase in the bleed pilot pressure of oxygen in the first chamber 314 compared to the demand pressure in the second chamber 316, a result which may deflect the diaphragm 318 downwards. Further, the deflection of the diaphragm 318 causes the lever 336 to operate the rod end 332 which in turn opens the main valve 330 and allows the pressurized oxygen to flow through the main valve opening into the mixing chamber 342 via the oxygen line 338.

The diaphragm 318 is also deflected downwards to operate the main valve 330 when the demand pressure in the second chamber 316 drops (e.g., usually when the person 170 flying in the pressurized aircraft cabin breathes). Thus, the demand dilution oxygen regulator 120 provides the appropriate dilution pressurized oxygen to the person 170 based on the demand. In other words, if the person breathes shallow, less amount of oxygen is provided and if the person breathes heavier more amount of oxygen is provided through the main valve opening to maintain the ratio of pressurized oxygen and aircraft cabin air constant. It should be noted that, the main valve 330 is in an open condition at pressure altitude of 2000 feet and above (i.e., upon closing of the first aneroid valve 310) for providing increased amount of pressurized oxygen to the breathing apparatus 150.

Also, as the aircraft cabin pressure altitude increases above 2000 feet, the aneroid capsule 354C associated with the second aneroid valve 354 further expands, thereby throttling the amount of aircraft cabin air outputted into the mixing chamber 342 via the outlet port 354B. In one embodiment, the aircraft cabin air is outputted into the mixing chamber 342 via the outlet port 354B such that the pressurized oxygen and the outputted aircraft cabin air are having substantially the same pressure.

Finally, the second aneroid valve 354 gradually closes at 4000 feet in pressure altitude, thereby stopping the flow of aircraft cabin air into the mixing chamber 342. Thus, the demand dilution oxygen regulator 120 outputs approximately about 100% pressurized oxygen to the breathing apparatus 150 via the breathing outlet 304 from the aircraft cabin pressure altitude of 4000 feet and above, upon substantially closing the second aneroid valve 354 and upon reaching 4000 feet.

As the aircraft cabin air and the pressurized oxygen outputted into the mixing chamber 342 are having substantially the same pressure, the mixing ratio of the aircraft cabin air and the pressurized oxygen is dependent on area of openings of the second aneroid valve 354 and the main valve 330. However, the area of the opening of the main valve 330 is almost constant. Thus, ratio control is achieved by virtue of reduction in the area of the opening of the second aneroid valve 354 (as the aneroid capsule 354C expands with increase in the aircraft cabin pressure altitude). Consequently, the percentage of flow of pressurized oxygen delivered to the breathing apparatus 150 keeps on increasing with increase in the aircraft cabin pressure altitude and becomes 100% upon substantially closing the second aneroid valve 354 and upon reaching the predefined aircraft cabin airflow stopping altitude point, e.g., 4000 feet.

The reason why the first aneroid valve 310 and the second aneroid valve 354, being matched pairs, close at different altitude points is that the valve members (310B, 354D) and the valve seats (310C, 354E) associated with each of the first aneroid valve 310 and the second aneroid valve 354 are relatively placed at different positions. In other words, for the first aneroid valve 310, the valve member 310B is placed relatively closer to the valve seat 310C as compared to the position of the valve member 354D and the valve seat 354E of the second aneroid valve 354, such that they close at different aircraft cabin pressure altitude points as set using the setting dial 130. It should be noted that, the demand dilution oxygen regulator 120 is also capable of supplying approximately about 100% pressurized oxygen during emergency (by manual operation of the emergency dilution shutoff lever 180) and upon the aircraft cabin pressure altitude reaching the aircraft cabin decompression point.

In case the aircraft cabin pressure altitude reaching the aircraft cabin decompression point, both the first aneroid valve 310 and the second aneroid valve 354 are closed automatically to stop the flow of aircraft cabin air into the mixing chamber 342 and to instantaneously supply 100% pressurized oxygen into the breathing apparatus 150 via the breathing outlet 304.

FIG. 4A illustrates a perspective view 400 of the cam plate 362 of the cam plate and follower mechanism 360 of FIG. 3, according to one embodiment. As shown in FIG. 4A, the cam plate 362 includes a cam 405 and a cam 410. It is appreciated that, the follower 364 experiences displacement in a linear direction when the cam 405 experiences an angular displacement. Similarly, the follower 366 experiences displacement in a linear direction when the cam 410 experiences an angular displacement. The angular displacement of the cams 405 and 410 is caused by the rotation of cam plate 362 in response to the adjustment of the adjustment dial 130A. Each of the cams 405 and 410 have a profile of 1800 and have minimum and maximum points placed 1800 apart. Thus, the cams 405 and 410 are designed to cause maximum and minimum displacements of the followers 364 and 366, respectively. In one embodiment, the cams 405 and 410 displace the followers 364 and 366 substantially simultaneously by the same distance.

Figure 4B:
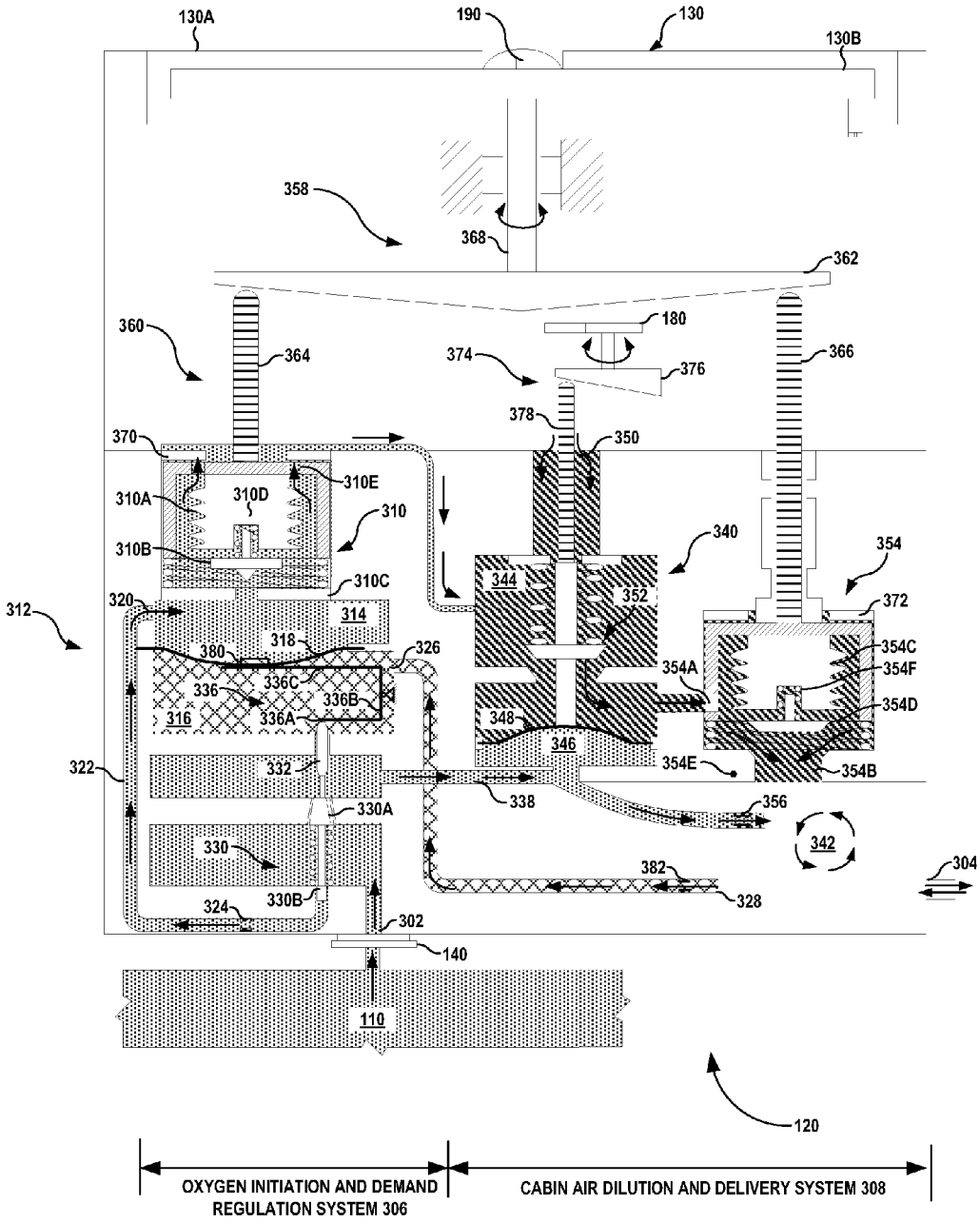
FIG. 4B illustrates a schematic representation depicting position of a first aneroid valve and a second aneroid valve preset when followers are displaced by a minimum amount.
Figure 4C:
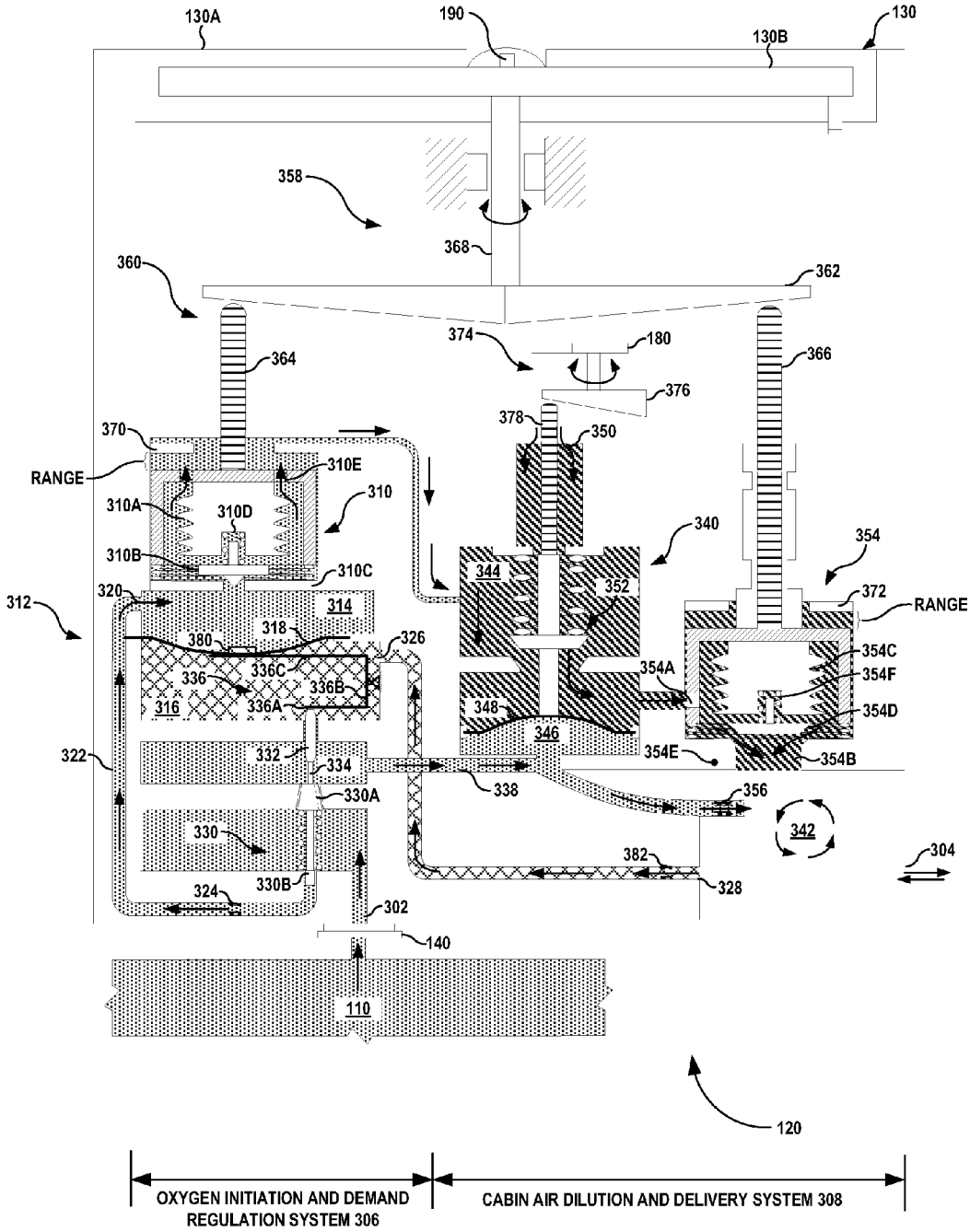
FIG. 4C illustrates a schematic representation depicting position of a first aneroid valve and a second aneroid valve preset when followers are displaced by a maximum amount.

FIG. 4B illustrates a schematic representation depicting the position of the first aneroid valve 310 and the second aneroid valve 354 preset when the followers 364 and 366 are displaced by the minimum amount. FIG. 4C illustrates a schematic representation depicting the position of the first aneroid valve 310 and the second aneroid valve 354 preset when the followers 364 and 366 are displaced by the maximum amount. It is appreciated that, the presetting of the first aneroid valve 310 and the second aneroid valve 354 enables presetting of an oxygen stating altitude point and a corresponding predefined aircraft cabin airflow stopping altitude point, respectively.

Figure 5:
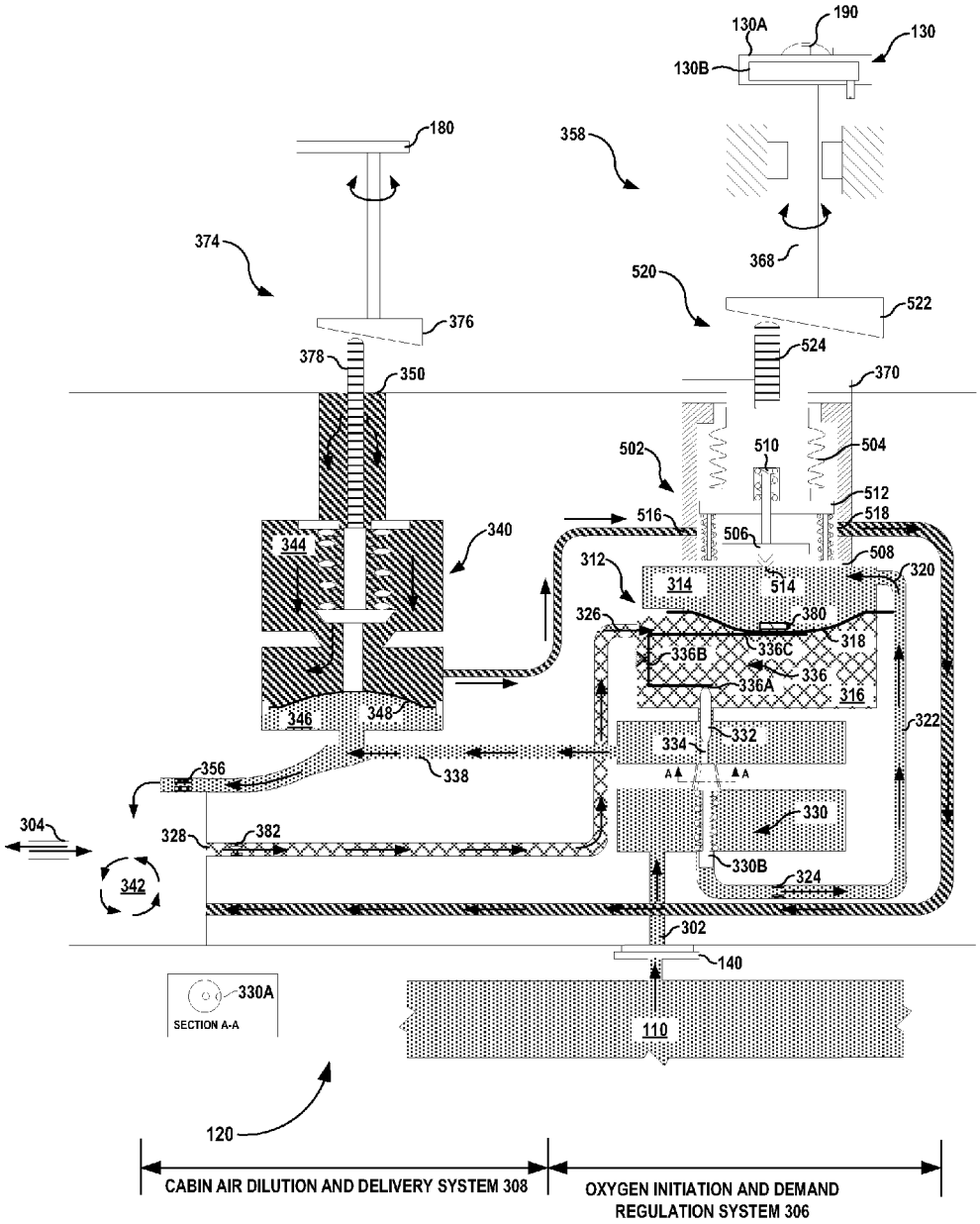
FIG. 5 is a schematic representation of an exemplary adaptable demand dilution oxygen regulator with a single aneroid valve, according to another embodiment.

FIG. 5 is a schematic representation of an exemplary adaptable demand dilution oxygen regulator 120 with a single aneroid valve 502, according to another embodiment. The demand dilution oxygen regulator 120 with the single aneroid valve 502 as shown in FIG. 5 is similar to the demand dilution oxygen regulator 120 of FIG. 3, except the demand dilution oxygen regulator 120 of FIG. 5 includes an aneroid valve 502 performing the functions of both the first aneroid valve 310 and the second aneroid valve 354 of FIG. 3.

The aneroid valve 502 is adapted to be responsive to differential gas pressure in a first altitude range (approximately about 2000 to 4000 feet in pressure altitude) and a second altitude range (approximately about 4000 to 6000 feet in pressure altitude). The aneroid valve 502 consists of an aneroid capsule 504, a first valve member 506, a valve seat 508 associated with the first valve member 506 and a light spring 510.

The aneroid valve 502 also consists of a second valve member 512 which is attached to the first valve member 506 using the light spring 510 which lightly biases the first valve member 506 toward the valve seat 508 during the first altitude range. It should be noted that, the first valve member 506 is operable during the first altitude range and the second valve member 512 is operable during the second altitude range.

Further, the aneroid valve 502 consists of a first inlet port 514 adapted to receive a pilot flow of oxygen from a first chamber 314 during the first altitude range and a second inlet port 516 adapted to receive aircraft cabin air from a first chamber 344 of a cabin air dilution and delivery system 308. Furthermore, the aneroid valve 502 consists of an outlet port 518 for outputting the partially enriched aircraft cabin air during the first altitude range and only aircraft cabin air during the second altitude range into a mixing chamber 342.

In one exemplary implementation, the outlet port 518 of the aneroid valve 502 gradually stops outputting the aircraft cabin air into the mixing chamber 342 upon closing of the second inlet port 516 by the second valve member 512 and upon reaching a predefined aircraft cabin airflow stopping altitude point to output approximately about 100% pressurized oxygen to the breathing apparatus 150.

In accordance with the above described embodiments and as shown in FIG. 5, a dial mechanism 358 includes a cam and follower mechanism 520 for presetting an oxygen starting altitude point to respond to differential gas pressure in the first altitude range based on a pulmonary capacity of the person 170 flying in the pressurized aircraft cabin and for presetting a corresponding predefined aircraft airflow stopping altitude point to respond to the differential gas pressure in the second altitude range and to stop dilution of aircraft cabin air into the mixing chamber 342.

Further, as shown in FIG. 5, the cam and follower mechanism 520 includes a cam 522 and a follower 524. The cam 522 is coupled to the setting dial 130 via a shaft 368. In one exemplary implementation, the cam 522 is adapted to be responsive to adjustment of the adjustment dial 130A of the setting dial 130 for presetting the oxygen starting altitude point and the corresponding predefined oxygen aircraft cabin airflow stopping altitude point.

As mentioned above, the oxygen starting altitude point and the corresponding predefined aircraft cabin airflow stopping altitude point are preset by the physician of the person 170 through rotation of the adjustment dial 130A. This causes the cam 522 to turn by an angle which in turn displaces the follower 524, coupled to the aneroid valve 502. Thus, the displacement of the follower 524 presets the aneroid valve 502.

For the purpose of illustration, consider that, at ground level (i.e., at 0 feet), a physician of the person 170 flying in the pressurized aircraft cabin presets the demand dilution oxygen regulator 120 to start flow of oxygen at a oxygen starting altitude point, say 2000 feet in pressure altitude and provide approximately about 100% pressurized oxygen at a predefined aircraft cabin airflow stopping altitude point, say 4000 feet, using the dial mechanism 358. Thus, the aneroid valve 502 operates in a first altitude range of 0 to 2000 feet and a second altitude range of 2000 to 4000 feet.

In operation, the oxygen supply from the portable personal oxygen bottle 110 to the demand dilution oxygen regulator 120 is initiated by switching on the quarter turn switching regulator 140 (by screwing it by quarter turn). When the quarter turn switching regulator 140 is switched on, the first inlet port 514, the second inlet port 516 and the outlet port 518 of the aneroid valve 502 are open. Further, the main valve 330 is in the closed position and the breathing outlet 304 of the demand dilution oxygen regulator 120 is connected to the breathing apparatus 150 of the person 170 flying in the pressurized aircraft cabin.

Upon initiation, as the main valve 330 is in the closed position, a minimum flow of oxygen is initiated via the minimum flow area 330A of the main valve 330 to the mixing chamber 342 and a pilot flow of oxygen is initiated via a bleed line 322 to the first chamber 314 through the first port 320. Further, the pilot flow of oxygen received from the first chamber 314 via the first inlet port 514 is mixed with aircraft cabin air and is outputted via the outlet port 518 into the mixing chamber 342.

Furthermore, the partially enriched aircraft cabin air from the outlet port 518 and the minimum flow of pressurized oxygen received via the main valve 330 are mixed into the mixing chamber 342 and outputted into the breathing apparatus 150 via the breathing outlet 304. The above-mentioned process occurs during the normal mode of operation, i.e., when the aircraft cabin pressure altitude is 0 feet. Since, the aneroid valve 502 is adapted to be responsive to the differential gas pressure in 0 to 2000 feet and 2000 to 4000 feet, working of the demand dilution oxygen regulator 120 when the aircraft cabin pressure altitude is in the range of 0 to 4000 feet to gradually supply approximately about 100% oxygen to the breathing apparatus 150 is discussed below.

As the aircraft cabin pressure altitude starts increasing (i.e., 0 feet and above), the aneroid capsule 504 associated with the aneroid valve 502 undergoes expansion. Due to which, the first valve member 506 associated with the aneroid valve 502 move toward the valve seat 508, thereby reducing the area of the first inlet port 514. Further, the first valve member 506 gradually closes the first inlet port 514 at 2000 feet (i.e., at the oxygen starting altitude point), and the pilot flow of oxygen from the first chamber 314 is stopped.

As a consequence, the outlet port 518 substantially outputs only the aircraft cabin air into the mixing chamber 342 from 2000 feet and above. The closing of the first inlet port 514 of the aneroid valve 502 at 2000 feet results in increase in bleed pilot pressure in the first chamber 314 compared to demand pressure in a second chamber 316, a result which may deflect a diaphragm 318 downwards. Further, the deflection of the diaphragm 318 causes a lever 336 to operate a rod end 332 which in turn opens the main valve 330 and allows pressurized oxygen to flow through the main valve opening into the mixing chamber 342 via an oxygen line 338.

The diaphragm 318 is also deflected downwards to operate the main valve 330 when the demand pressure in a second chamber 316 drops (e.g., usually when the person 170 flying in the pressurized aircraft cabin breathes). Thus, the demand dilution oxygen regulator 120 is capable of providing the pressurized oxygen to the person 170 based on his/her pulmonary capacity, i.e., if the person breathes shallow, less amount of oxygen is provided and if the person breathes heavier more amount of oxygen is provided through the main valve opening. It should be noted that, the main valve 330 is in an open condition at pressure altitude of 2000 feet and above (i.e., upon closing of the first inlet port 514) for providing increased amount of oxygen to the breathing apparatus 150.

Also, as the aircraft cabin pressure altitude increases above 2000 feet, the aneroid capsule 504 associated with the aneroid valve 502 further expands, thereby throttling the amount of aircraft cabin air outputted into the mixing chamber 342 via the outlet port 518. In one embodiment, the aircraft cabin air is outputted into the mixing chamber 342 via the outlet port 518 such that the pressurized oxygen and the outputted aircraft cabin air are having substantially the same pressure. Finally, the second valve member 512 of the aneroid valve 502 gradually closes the second inlet port 516 at 4000 feet, thereby stopping the flow of aircraft cabin air into the mixing chamber 342. Thus, the demand dilution oxygen regulator 120 outputs approximately about 100% pressurized oxygen into the breathing apparatus 150 via the breathing outlet 304 from aircraft cabin pressure altitude of 4000 feet and above, upon substantially closing the second inlet port 516 and upon reaching 4000 feet.

As the aircraft cabin air and the pressurized oxygen outputted into the mixing chamber 342 are having substantially the same pressure, the mixing ratio of the aircraft cabin air and the pressurized oxygen is dependent on area of openings of the second inlet port 516 and the main valve 330. However, the area of the opening of the main valve 330 is almost constant. Thus, ratio control is achieved by virtue of reduction in the area of the opening of the second inlet port 516 (as the aneroid capsule 504 expands with increase in the aircraft cabin pressure altitude). Consequently, the percentage of pressurized oxygen delivered to the breathing apparatus 150 keeps on increasing with increase in the aircraft cabin pressure altitude and becomes 100% upon substantially closing the second inlet port 516 and upon reaching 4000 feet.

It should be noted that, the demand dilution oxygen regulator 120 is also capable of supplying approximately about 100% pressurized oxygen during emergency (by manual operation of the emergency dilution shutoff lever 180) and upon the aircraft cabin pressure altitude reaching the aircraft cabin decompression point.

In case the aircraft cabin pressure altitude reaching the aircraft cabin decompression point, the second inlet port 516 of the aneroid valve 502 is closed automatically to stop the flow of aircraft cabin air into the mixing chamber 342 and to instantaneously supply 100% pressurized oxygen into the breathing apparatus 150 via the breathing outlet 304.

Figure 6:
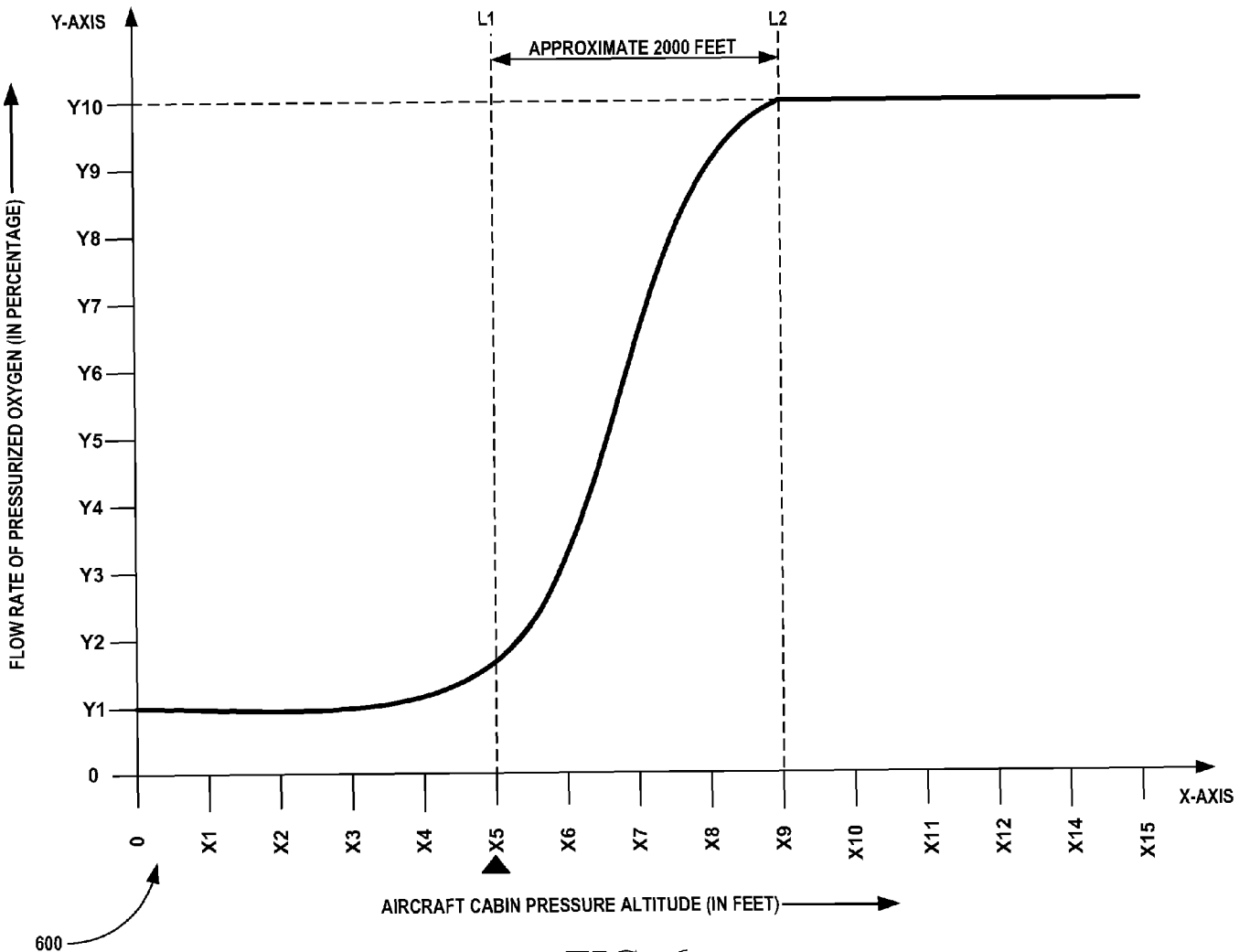
FIG. 6 illustrates an exemplary graph showing flow rate of oxygen delivered automatically by the demand dilution oxygen regulator to a person flying in the pressurized aircraft cabin, according to one embodiment.

FIG. 6 illustrates an exemplary graph 600 showing flow rate of oxygen delivered automatically by the demand dilution oxygen regulator 120 to the person 170 flying in the pressurized aircraft cabin, according to one embodiment. As shown in FIG. 6, X axis represents an aircraft cabin pressure altitude in feet and Y axis represents flow rate of pressurized oxygen delivered to the breathing apparatus 150 in percentage.

Further, the graph 600 shows L1 as an oxygen starting altitude point, and L2 as a predefined aircraft cabin airflow stopping altitude point (preset by the physician of the person 170 using the setting dial 130). It should be noted that, the first aneroid valve 310 is preset to close at L1 and the second aneroid valve 354 is preset to close at L2. Further, the difference between L1 and L2 is approximately 2000 feet.

It can be seen in FIG. 6 that, a small percentage of oxygen (Y1%) is provided to the breathing apparatus 150 at ground level (i.e., 0 feet in pressure altitude) due to the pilot flow of oxygen vented into the cabin air dilution path and minimum flow of pressurized oxygen supplied through the minimum flow area 330A into the mixing chamber 342 to mix with aircraft cabin air. Further, it can be seen in FIG. 6 that, the small percentage of oxygen (Y1%) is supplied to the breathing apparatus 150 till the aircraft cabin pressure altitude reaches X5 feet.

Furthermore, as depicted in graph 600, the percentage of flow of pressurized oxygen gradually increases from Y1% to Y10% (i.e., approximately about 100%) as the aircraft cabin pressure altitude increases from X5 feet (at point L1 at which the main valve 330 opens) to X9 feet (at point L2 at which the aircraft cabin air flow into the mixing chamber 342 is stopped and approximately about 100% pressurized oxygen is provided) and remains constant thereafter.

Thus, from the graph 600, it can be construed that the adaptable and configurable demand dilution oxygen regulator 120 as shown in FIGS. 3 and 5 is capable of delivering appropriate flow rate of pressurized oxygen to the breathing apparatus 150 based on the setting provided by the physician of the person 170 flying in the pressurized aircraft cabin.

Figure 7:
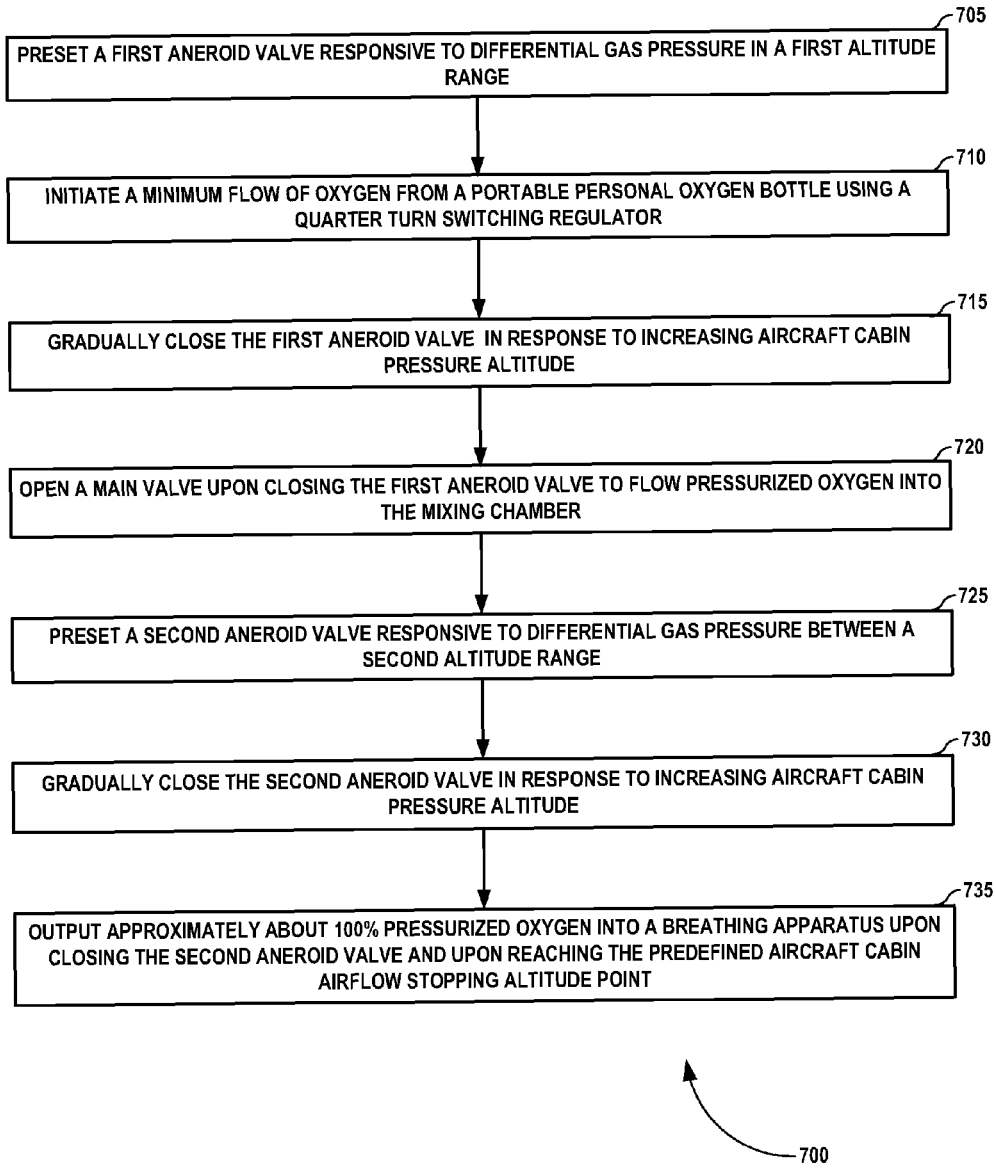
FIG. 7 is a process flowchart of an exemplary method of automatic delivery of appropriate flow rate of diluted or undiluted oxygen from a portable personal oxygen bottle through a breathing apparatus to a person flying in a pressurized aircraft cabin, according to one embodiment.

FIG. 7 is a process flowchart 700 of an exemplary method of automatic delivery of appropriate flow rate of diluted or undiluted oxygen from a portable personal oxygen bottle through a breathing apparatus to a person flying in a pressurized aircraft cabin, according to one embodiment. In operation 705, a first aneroid valve that is responsive to differential gas pressure in a first altitude range (e.g., about 2000 to 4000 feet in pressure altitude) is preset to close at an oxygen starting altitude point (e.g., approximately about 4000 feet) based on a priori lung capacity test.

In operation 710, a flow of oxygen from the portable personal oxygen bottle is initiated using a quarter turn switching regulator connected to the portable personal oxygen bottle via a minimum flow area of the main valve to output the mixture of the flow of oxygen and aircraft cabin air into a mixing chamber. In operation 715, the first aneroid valve is gradually closed in response to increasing aircraft cabin pressure altitude to stop a pilot flow of oxygen during the first altitude range.

In operation 720, a main valve is opened upon closing the first aneroid valve to flow pressurized oxygen into the mixing chamber. In some embodiments, the aircraft cabin air is outputted into the mixing chamber such that the pressurized oxygen and the outputted aircraft cabin air are having substantially same pressure. In these embodiments, the mixture of aircraft cabin air and pressurized oxygen in the mixing chamber is outputted into the breathing apparatus via a breathing outlet.

In operation 725, a second aneroid valve that is responsive to differential gas pressure in a second altitude range (e.g., about 4000 to 6000 feet in pressure altitude) is preset to close at a predefined aircraft cabin airflow stopping altitude point (e.g., approximately about 6000 feet), substantially simultaneously upon presetting the first aneroid valve to the oxygen starting altitude point. The second altitude range is higher than the first altitude range and the predefined aircraft cabin airflow stopping altitude point is substantially above the oxygen starting altitude point.

In operation 730, the second aneroid valve is gradually closed in response to increasing aircraft cabin pressure altitude to stop the aircraft cabin air flowing into the mixing chamber during the second altitude range. In operation 735, approximately about 100% pressurized oxygen is outputted into the breathing apparatus via the breathing outlet upon substantially closing the second aneroid valve and upon reaching the predefined aircraft cabin airflow stopping altitude point.

In accordance with the above described embodiments, the aircraft cabin air coming into the mixing chamber is manually shutoff to provide approximately about 100% pressurized oxygen into the breathing apparatus via the breathing outlet during an emergency (i.e., when the need arises irrespective of the aircraft cabin pressure altitude) by using an emergency dilution shutoff lever to close a cabin air valve. Also, the first aneroid valve and the second aneroid valve are automatically instantaneously closed to stop the flow of the aircraft cabin air into the mixing chamber upon reaching an aircraft cabin decompression point to instantaneously supply approximately about 100% pressurized oxygen into the breathing apparatus via the breathing outlet.

The above-described system enables person with impaired/reduced pulmonary function who would be otherwise unable, to travel safely in a pressurized aircraft cabin (with the attendant lower oxygen levels and lower ambient pressure (i.e., higher altitude of 5000-7000 feet) than is normally encountered at ground level) safely without risk of respiratory distress (hypoxia, hyperventilation, syncope, and the like). In other words, the above-described system provides the person a higher partial pressure of oxygen (PO2) in lung alveoli and hence an equivalent lower altitude to ensure sufficient saturation of hemoglobin as compared to other passengers in the same pressurized aircraft cabin who are breathing aircraft cabin air. Thus, the above-described system enables safe, economic, unhindered passage/evacuation of the person with impaired/reduced pulmonary function.

The above-described system is adaptable/configurable and suitable for use by individuals based on tests (e.g., lung forced expiration volume (FEV) test, lung capacity test, etc.) and is targeted for use by a small percentage of population. The abovedescribed regulator facilitates the person to travel longer distances using a portable personal oxygen bottle (e.g., 2 to 7 liters capacity) as oxygen is not wasted and is supplied as per the requirement. In one embodiment, the demand dilution oxygen regulator automatically delivers appropriate flow rate of diluted or undiluted oxygen without intervention by a physician/medical attendants of the invalid person once the initial setting has been determined as suiting the invalid person.

Further, the above-described system delivers approximately about 100% pressurized oxygen during emergency and when aircraft cabin pressure altitude reaches an aircraft cabin decompression point so that the person can stay on a single supply (independent) without the need to switch over to a aircraft cabin drop down/pull down mask.

A skilled person will recognize that many suitable designs of the systems and processes may be substituted for or used in addition to the configurations described above. It should be understood that the implementation of other variations and modifications of the embodiments of the invention and its various aspects will be apparent to one ordinarily skilled in the art, and that the invention is not limited by the exemplary embodiments described herein and in the claims. Therefore, it is contemplated to cover the present embodiments of the invention and any and all modifications, variations, or equivalents that fall within the true spirit and scope of the basic underlying principles disclosed and claimed herein.

What is claimed is:

1. An adaptable demand dilution oxygen regulator for use inside a pressurized aircraft cabin, comprising:

an oxygen initiation and demand regulation system adapted to be responsive to differential gas pressure in a first altitude range based on a pulmonary capacity of a person flying in the pressurized aircraft cabin, wherein the oxygen initiation and demand regulation system controls flow of pressurized oxygen to a breathing outlet by mixing the pressurized oxygen with aircraft cabin air during the first altitude range; and a cabin air dilution and delivery system coupled to the oxygen initiation and demand regulation system, wherein the cabin air dilution and delivery system is adapted to be responsive to differential gas pressure in a second altitude range, and wherein the cabin air dilution and delivery system gradually stops dilution of the aircraft cabin air and outputs about 100% pressurized oxygen into a breathing apparatus via the breathing outlet during the second altitude range, and wherein the first altitude range and the second altitude range are substantially below a cabin pressure altitude of about 7000 feet, and wherein the first altitude range is lower than the second altitude range.

2. The regulator of claim 1, wherein the oxygen initiation and demand regulation system comprises:

a first aneroid valve adapted to be responsive to differential gas pressure in the first altitude range based on the pulmonary capacity of the person flying in the pressurized aircraft cabin;

a first port associated with the first aneroid valve adapted to receive a pilot flow oxygen via a bleed line;

a second port associated with the first aneroid valve adapted to receive demand pressure via the breathing apparatus;

an outlet associated with the first aneroid valve to vent a pilot flow of oxygen to a cabin air dilution path in the first altitude range; and a balanced oxygen delivery valve, comprising:

a first chamber;

a main valve; and a second chamber, wherein the first chamber and the second chamber are separated by a first diaphragm, and wherein the first diaphragm associated with the first aneroid valve is responsive to the differential gas pressure in the first chamber and the second chamber based on the first altitude range for regulating the main valve via the first diaphragm to control the flow of pressurized oxygen to the breathing outlet.

3. An adaptable demand dilution oxygen regulator for use inside a pressurized aircraft cabin, comprising:

an oxygen initiation and demand regulation system adapted to be responsive to differential gas pressure in a first altitude range based on a pulmonary capacity of a person flying in the pressurized aircraft cabin, wherein the oxygen initiation and demand regulation system controls flow of pressurized oxygen to a breathing outlet by mixing the pressurized oxygen with aircraft cabin air during the first altitude range, wherein the oxygen initiation and demand regulation system comprises:

a first aneroid valve adapted to be responsive to differential gas pressure in the first altitude range based on the pulmonary capacity of the person flying in the pressurized aircraft cabin;

a first port associated with the first aneroid valve adapted to receive a pilot flow oxygen via a bleed line;

a second port associated with the first aneroid valve adapted to receive demand pressure via the breathing apparatus;

an outlet associated with the first aneroid valve to vent a pilot flow of oxygen to a cabin air dilution path in the first altitude range; and a balanced oxygen delivery valve, comprising:

a first chamber;

a main valve; and a second chamber, wherein the first chamber and the second chamber are separated by a first diaphragm, and wherein the first diaphragm associated with the first aneroid valve is responsive to the differential gas pressure in the first chamber and the second chamber based on the first altitude range for regulating the main valve via the first diaphragm to control the flow of pressurized oxygen to the breathing outlet; and a cabin air dilution and delivery system coupled to the oxygen initiation and demand regulation system, wherein the cabin air dilution and delivery system is adapted to be responsive to differential gas pressure in a second altitude range, and wherein the cabin air dilution and delivery system gradually stops dilution of the aircraft cabin air and outputs about 100% pressurized oxygen into a breathing apparatus via the breathing outlet during the second altitude range, and wherein the first altitude range and the second altitude range are substantially below a cabin pressure altitude of about 7000 feet, and wherein the first altitude range is lower than the second altitude range, wherein the cabin air dilution and delivery system comprises:

a mixing chamber; and a cabin air chamber having a first chamber and a second chamber separated by a second diaphragm, wherein the first chamber is adapted to receive the aircraft cabin air from an aircraft cabin air inlet, and wherein the second chamber is adapted to receive the flow of pressurized oxygen from the main valve, and wherein the cabin air chamber includes a cabin air valve, and wherein the second diaphragm regulates the cabin air valve such that the pressure of the aircraft cabin air and the flow of pressurized oxygen via an oxygen line going into the mixing chamber are substantially equal.

4. The regulator of claim 3, wherein the cabin air dilution and delivery system further comprises:

a second aneroid valve adapted to be responsive to differential gas pressure in the second altitude range;

an outlet port associated with the second aneroid valve; and an inlet port associated with the second aneroid valve adapted to receive the aircraft cabin air from the first chamber of the cabin air chamber;

wherein the second aneroid valve is responsive to the differential gas pressure in the second altitude range for regulating flow of the aircraft cabin air going into the mixing chamber via the outlet port associated with the second aneroid valve.

5. The regulator of claim 4, further comprising a dial mechanism for presetting an oxygen starting altitude point in the first altitude range for providing the flow of pressurized oxygen via the main valve and for providing a visual means to see the preset oxygen starting altitude point.

6. The regulator of claim 5, wherein the dial mechanism comprises a cam plate and follower mechanism operable for presetting the oxygen starting altitude point to respond to the differential gas pressure in the first altitude range based on the pulmonary capacity of the person flying in the pressurized aircraft cabin.

7. The regulator of claim 6, wherein the cam plate and follower mechanism is further operable for simultaneously presetting a corresponding predefined aircraft cabin airflow stopping altitude point to respond to the differential gas pressure in the second altitude range, and wherein the predefined aircraft cabin airflow stopping altitude point is substantially above the oxygen starting altitude point.

8. The regulator of claim 4, further comprising:

an emergency dilution shutoff lever including a cam and follower mechanism for shutting off the aircraft cabin air flowing into the mixing chamber and for providing approximately about 100% pressurized oxygen via the breathing outlet, wherein the cabin air valve is coupled to the emergency dilution shutoff lever and is responsive to the differential gas pressure between the flow of pressurized oxygen to the breathing outlet and the aircraft cabin air in the cabin air chamber to regulate the mixture of the flow of pressurized oxygen and the aircraft cabin air received in the mixing chamber.

9. The regulator of claim 4, further comprising a portable personal oxygen bottle coupled to the first port.

10. The regulator of claim 4, further comprising:

a demand pressure inlet adapted to receive demand pressure from the breathing outlet, wherein the demand pressure inlet is connected to the second chamber of the balanced oxygen delivery valve and adapted to regulate the main valve to control the flow of pressurized oxygen to the breathing outlet based on the received demand pressure via the demand pressure inlet.

11. The regulator of claim 1, wherein the first altitude range is in the range of 2000 to 4000 feet in pressure altitude.

12. The regulator of claim 1, wherein the second altitude range is in the range of 4000 to 6000 feet in pressure altitude.

13. The regulator of claim 1, further comprising a dial mechanism for presetting of an oxygen starting altitude point in the first altitude range and a corresponding predefined aircraft cabin airflow stopping altitude point in the second altitude range, wherein the predefined aircraft cabin airflow stopping altitude point is substantially above the oxygen starting altitude point.

* * * * *